US006107905A

United States Patent [19]

Itoh et al.

[11] Patent Number: 6,107,905

[45] Date of Patent: Aug. 22, 2000

[54] SUPERCONDUCTING MAGNET APPARATUS

[75] Inventors: Koji Itoh, Ayase; Michitaka Ono; Toru Kuriyama, both of Kawasaki; Yasutsugu Morii, Funabashi, all of Japan

[73] Assignee: Kabushiki Kaisha Toshiba, Kawasaki, Japan

[21] Appl. No.: 09/276,493

[22] Filed: Mar. 25, 1999

[30] Foreign Application Priority Data

Mar. 31, 1998 [JP] Japan ..... 10-101932

[51] Int. Cl.[7] ..... H01F 1/00

[52] U.S. Cl. ..... 335/216; 335/300; 505/892

[58] Field of Search ..... 335/216, 299, 335/300; 324/318, 321; 505/888, 890, 891, 892, 894, 895, 897, 901; 62/51.1, 52

[56] References Cited

U.S. PATENT DOCUMENTS

| | | | |
|---|---|---|---|
| 4,726,199 | 2/1988 | Takano et al. | 335/216 |
| 4,926,647 | 5/1990 | Dorri et al. . | |
| 5,410,286 | 4/1995 | Herd et al. . | |
| 5,485,730 | 1/1996 | Herd . | |
| 5,513,498 | 5/1996 | Ackermann et al. . | |
| 5,584,184 | 12/1996 | Inaguchi et al. | 62/51.1 |
| 5,586,437 | 12/1996 | Blecher et al. | 62/51.1 |
| 5,737,927 | 4/1998 | Takahashi et al. | 62/51.1 |

FOREIGN PATENT DOCUMENTS

| | | |
|---|---|---|
| 6-267741 | 9/1994 | Japan . |
| 8-78737 | 3/1996 | Japan . |
| 2 274 155 | 7/1994 | United Kingdom . |

*Primary Examiner*—Lincoln Donovan
*Attorney, Agent, or Firm*—Oblon, Spivak, McClelland, Maier & Neustadt, P.C.

[57] ABSTRACT

A superconducting magnet apparatus including a superconducting coil for generating a magnetic field, a radiation shield surrounding the superconducting coil, a refrigerator for cooling the superconducting coil, and a cryostat provided inside the radiation shield to store a coolant cooled by the refrigerator, wherein the cryostat is thermally connected to the superconducting coil.

22 Claims, 8 Drawing Sheets

SUPERCONDUCTING MAGNET APPARATUS

BACKGROUND OF THE INVENTION

The present invention relates to a superconducting magnet apparatus for, e.g., a synchrotron orbital radiation device.

For cooling a superconducting coil for a superconducting magnet apparatus, immersion cooling of immersing a superconducting coil in a coolant and cooling it with the latent heat of evaporation of the coolant, and direct cooling with a refrigerator are generally used.

FIG. 1 is an example of a superconducting magnet apparatus employing immersion cooling and shows a superconducting magnet apparatus for a synchrotron orbital radiation device. The superconducting magnet apparatus shown in FIG. 1 comprises a pair of superconducting coils 1. A radiation shield 2 surrounds the superconducting coils 1, and a high temperature-side shield 3 and a vacuum vessel 4 surround the radiation shield 2.

The superconducting coils 1 are respectively stored in coil containers 18, and a helium container 6 containing liquid helium 5 as a coolant and the coil containers 18 communicate with each other through pipes 6*a*. The superconducting coils 1 are immersed in the liquid helium 5 and held at a temperature of about 4.2 K. A helium liquefying refrigerator 7 is mounted on the helium container 6 to liquefy evaporated helium of the liquid helium 5 again.

The shield cooling refrigerator 8 cools the radiation shield 2 and high temperature-side shield 3 with a low temperature-side stage 8*a* and a high temperature-side stage 8*b*, respectively, and hold them at temperatures of 20 K and about 80 K, respectively. A beam chamber 9 is enclosed within a beam chamber radiation shield 10 and then by a beam chamber high temperature-side radiation shield 11.

During ordinary operation, the superconducting coils 1 have no electric resistance and do not generate heat. When there is influx of heat into the superconducting coils 1 from the outside by convection, conduction, or radiation, the heat that has entered the system is removed by evaporation of the liquid helium 5, and the evaporated helium is liquefied again by the helium liquefying refrigerator 7.

FIG. 2 shows an example of a superconducting magnet for direct cooling with a refrigerator. Referring to FIG. 2, a superconducting coil 1 is supported by heat insulating support members 26 and surrounded by a radiation shield 2. The radiation shield 2 is surrounded by a vacuum vessel 4. A low temperature-side stage 7*a* of a refrigerator 7 is thermally connected to the superconducting coil 1 through a heat conducting member 12, and a high temperature-side stage 7*b* thereof is thermally connected to the radiation shield 2. The low and high temperature-side stages 7*a* and 7*b* are respectively cooled to temperatures of about 4.2 K and 80 K. In this manner, since the refrigerator direct cooling type superconducting magnet apparatus does not use liquid helium 5, it is easy to handle and is suitable as a comparatively compact superconducting magnet apparatus. The refrigerator 7 for holding a temperature of 4.2 K currently has a capacity of as low as about 1 W and thus cannot be used for a large superconducting magnet apparatus.

In this superconducting magnet apparatus, the superconducting coil 1 is cooled to about 4.2 K by heat conduction with the low temperature-side stage 7*a* of the refrigerator 7 through the heat conducting member 12, so that its electric resistance becomes zero to reach a so-called superconducting state. In this state, an energizing current is supplied to the superconducting coil 1 from an external power supply (not shown) to generate a required magnetic field.

During ordinary operation, since the superconducting coil 1 has no electric resistance, the superconducting coil 1 does not generate heat by itself with Joule heat even if a current is supplied to it. However, there is influx of heat into the superconducting coil 1 from the outside by convection, conduction, or radiation. As described above, since the cooling capacity of one refrigerator 7 is limited, in the case of the refrigerator direct cooling type superconducting magnet apparatus, it is desired to decrease this heat invasion as much as possible.

In the conventional superconducting magnet apparatus that employs immersion cooling, as shown in FIG. 1, superconducting coils 1 are immersed in the liquid helium 5 to be cooled by its latent heat of evaporation. While this apparatus has high cooling characteristics, its liquid helium 5 is difficult to handle.

More specifically, prior to the operation, the liquid helium 5 must be reserved in the coil containers 18 that store the superconducting coils 1. This must be done by a person skilled in the art who has a necessary qualification. When the superconducting coils 1 are quenched (shift from superconduction to normal conduction) by a disturbance, they generate a very large Joule heat, and the reserved liquid helium 5 evaporates instantaneously. Generally, evaporated helium gas is stored in an external gas back temporarily or is discharged to the atmosphere. In this manner, when the superconducting coils 1 are quenched, liquid helium 5 must be supplied to the helium container 6 again.

The amount of liquid helium 5 to be used must be decreased as much as possible. However, in the case of immersion cooling, the use amount of liquid helium 5 is often determined by the size of the coil containers 18 depending on the size of the superconducting coils 1, and an optimum amount of helium liquid is not always stored. This causes a difficulty in handling and poses a problem in terms of conservation of natural resources as well.

Since the superconducting magnet apparatus employing direct cooling with a refrigerator as shown in FIG. 2 does not use liquid helium, it does not require liquid supplying operation and the like and can thus be handled easily. However, the cooling capacity of this apparatus is determined by the capacity of the mounted refrigerator 7. Generally, the superconducting coil 1 generates no heat while a constant current is supplied to it. However, during energization/deenergization such as turning ON/OFF, heat is generated by a large AC loss. When turning ON/OFF is very slow and takes a long period of time (from several ten minutes to 1 hour), cooling with the refrigerator can be performed. However, in a superconducting magnet apparatus that must be energized/deenergized within a short period of time (within several ten minutes), the AC loss sometimes reaches 10 times or more the heat influx.

Therefore, the number of refrigerators 7 must be increased, or a refrigerator 7 having a large capacity must be loaded to remove heat generated by AC loss. AC loss occurs only during short-time energization/deenergization, and such a measure is very uneconomical when considering long-term ordinary operation. When a large superconducting coil 1 is to be employed or a plurality of superconducting coils 1 are to be cooled with one refrigerator 7, as the refrigerator 7 and the superconducting coils 1 are thermally connected to each other through the heat conducting member 12, a temperature difference occurs among the respective portions of the superconducting coil 1 or among the respective superconducting coils 1 to cause quenching.

BRIEF SUMMARY OF THE INVENTION

The present invention has been made in order to solve the conventional problems described above, and has as its object to provide a superconducting magnet apparatus in which a superconducting coil need not be immersed in a coolant and which has a high cooling capacity, can be handled easily, and is economical, thus improving the reliability.

In order to achieve the above object, according to the first aspect of the present invention, there is provided a superconducting magnet apparatus comprising a superconducting coil for generating a magnetic field, a radiation shield surrounding the superconducting coil, a refrigerator for cooling the superconducting coil, and a cryostat provided inside the radiation shield to store a coolant cooled by the refrigerator, the cryostat being thermally connected to the superconducting coil.

In the superconducting magnet apparatus of the first aspect, the coolant cooled by the refrigerator is stored in the cryostat placed inside the radiation shield, to cool the superconducting coil thermally connected to the cryostat.

According to the second aspect of the present invention, there is provided a superconducting magnet apparatus comprising a superconducting coil for generating a magnetic field, a radiation shield surrounding the superconducting coil, a refrigerator for cooling the superconducting coil, a cryostat provided inside the radiation shield to store a coolant cooled by the refrigerator, and a cooling pipe provided in thermal contact with the superconducting coil to circulate the coolant stored in the cryostat.

In the superconducting magnet apparatus of the second aspect, the coolant cooled by the refrigerator is stored in the cryostat placed inside the radiation shield, and the coolant stored in the cryostat is circulated through the cooling pipe provided in thermal contact with the superconducting coil.

According to the third aspect of the present invention, there is provided a superconducting magnet apparatus comprising a plurality of superconducting coils for generating a magnetic field, a radiation shield integrally surrounding the plurality of superconducting coils, a refrigerator for cooling the superconducting coils, a common cooling plate for thermally connecting the plurality of superconducting coils to each other, and a cryostat provided inside the radiation shield to store a coolant cooled by the refrigerator, the cryostat being thermally connected to the common cooling plate through a heat conducting member.

In the superconducting magnet apparatus of the third aspect, the plurality of superconducting coils are thermally connected to each other with the common cooling plate, and the coolant cooled by the refrigerator is stored in the cryostat placed inside the radiation shield. The superconducting coils are cooled through the heat conducting member thermally connected to the common cooling plate.

According to the fourth aspect of the present invention, there is provided a superconducting magnet apparatus comprising a plurality of superconducting coils for generating a magnetic field, a radiation shield integrally surrounding the plurality of superconducting coils, a refrigerator for cooling the superconducting coils, a common cooling plate for thermally connecting the plurality of superconducting coils, a cryostat provided inside the radiation shield to store a coolant cooled by the refrigerator, and a cooling pipe provided in thermal contact with the common cooling plate, to circulate the coolant stored in the cryostat.

In the superconducting magnet apparatus of the fourth aspect, the plurality of superconducting coils are thermally connected to each other with the common cooling plate, and the coolant cooled by the refrigerator is stored in the cryostat formed inside the radiation shield. The coolant stored in the cryostat is circulated through the cooling pipe provided in thermal contact with the common cooling plate, thereby cooling the superconducting coils.

According to the fifth aspect of the present invention, there is provided a superconducting magnet apparatus according to the first to fourth aspects, wherein the refrigerator liquefies the coolant in the cryostat.

In the superconducting magnet apparatus of the fifth aspect, in addition to the functions of the superconducting magnet apparatus of the first to fourth aspects, the coolant in the cryostat is liquefied by the refrigerator.

Furthermore, according to the sixth aspect of the present invention, there is provided a superconducting magnet apparatus according to the first to third aspects, wherein the cryostat comprises a container formed of a stainless steel tube to store the coolant, and a block made of a good heat conductor to hold the container.

In the superconducting magnet apparatus of the sixth aspect, in addition to the functions of the superconducting magnet apparatus of the first to third aspects, the coolant is stored in the container, formed of the stainless steel pipe, of the cryostat. This stainless steel container is supported by the block made of the good heat conductor.

According to the seventh aspect of the present invention, there is provided a superconducting magnet apparatus according to the first or third aspect, wherein the heat conducting member is a heat pipe.

In the superconducting magnet apparatus of the seventh aspect, in addition to the function of the superconducting magnet apparatus of the first or third aspect, heat exchange between the coolant and the superconducting coil is performed by the heat pipe serving as the heat conducting member.

According to the eighth aspect of the present invention, there is provided a superconducting magnet apparatus according to the first or second aspect, further comprising a pre-cooling pipe provided to at least one of the superconducting coil and the cryostat.

In the superconducting magnet apparatus of the eighth aspect, in addition to the function of the superconducting magnet apparatus of the first or second aspect, the coolant is supplied to the pre-cooling pipe provided to the superconducting coil or cryostat to pre-cool it.

According to the ninth aspect of the present invention, there is provided a superconducting magnet apparatus according to the third or fourth aspect, further comprising a pre-cooling pipe provided to at least one of the common cooling plate and the cryostat.

In the superconducting magnet apparatus of the ninth aspect, in addition to the function of the superconducting magnet apparatus of the third or fourth aspect, the coolant is supplied to the pre-cooling pipe provided to the common cooling plate or cryostat to pre-cool it.

According to the tenth aspect of the present invention, there is provided a superconducting magnet apparatus according to the fifth aspect, further comprising a vacuum vessel surrounding the radiation shield, a storage tank provided to the vacuum vessel to store a gas of the coolant, and a communicating pipe for allowing the storage tank and the cryostat to communicate with each other.

In the superconducting magnet apparatus of the tenth aspect, in addition to the function of the superconducting magnet apparatus of the fifth aspect, when the coolant gasifies in the cryostat by quenching or the like, the gas of the coolant is stored in the storage tank formed in the vacuum vessel through the communication pipe.

According to the eleventh aspect of the present invention, there is provided a superconducting magnet apparatus according to the tenth aspect, wherein the storage tank is integrally formed with the vacuum vessel.

In the superconducting magnet apparatus of the eleventh aspect, in addition to the function of the superconducting magnet apparatus of the tenth aspect, a coolant gas is stored in the storage tank.

According to the twelfth aspect of the present invention, there is provided a superconducting magnet apparatus comprising a superconducting coil for generating a magnetic field, a radiation shield surrounding the superconducting coil, and a refrigerator for cooling the superconducting coil, wherein the apparatus further comprises a cryogenic pipe provided in direct or indirect thermal contact with the superconducting coil, to circulate a liquefied coolant supplied from the refrigerator.

In the superconducting magnet apparatus of the twelfth aspect, the coolant cooled by the refrigerator is circulated through the cryogenic pipe provided in thermal contact with the superconducting coil, thereby cooling the superconducting coil.

According to the thirteenth aspect of the present invention, there is provided a superconducting magnet apparatus according to the twelfth aspect, further comprising a coolant reservoir formed in part of the cryogenic pipe to have a diameter larger than that of the cryogenic pipe.

In the superconducting magnet apparatus of the thirteenth aspect, in addition to the function of the superconducting magnet apparatus of the twelfth aspect, the coolant cooled by the refrigerator is circulated through the cryogenic pipe while being held in the coolant reservoir having a diameter larger than that of the cryogenic pipe, to cool the superconducting coil.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
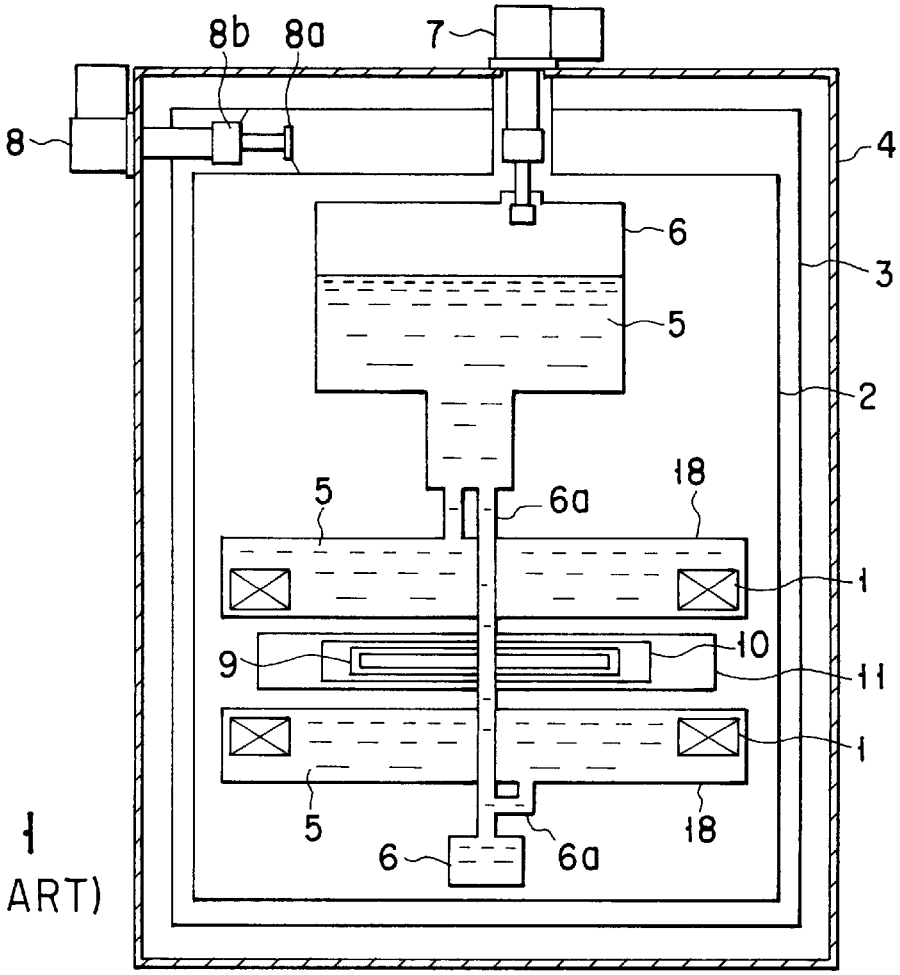
FIG. 1 (PRIOR ART)
FIG. 1 is a sectional view of a conventional superconducting magnet apparatus employing immersion cooling.
Figure 2:
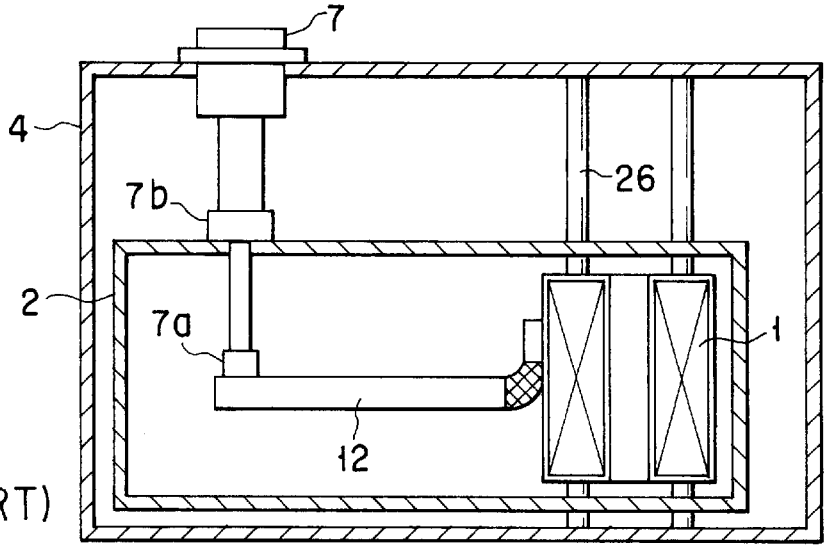
FIG. 2 (PRIOR ART)
FIG. 2 is a sectional view of a conventional superconducting magnet apparatus employing direct cooling with a refrigerator.
Figure 3:
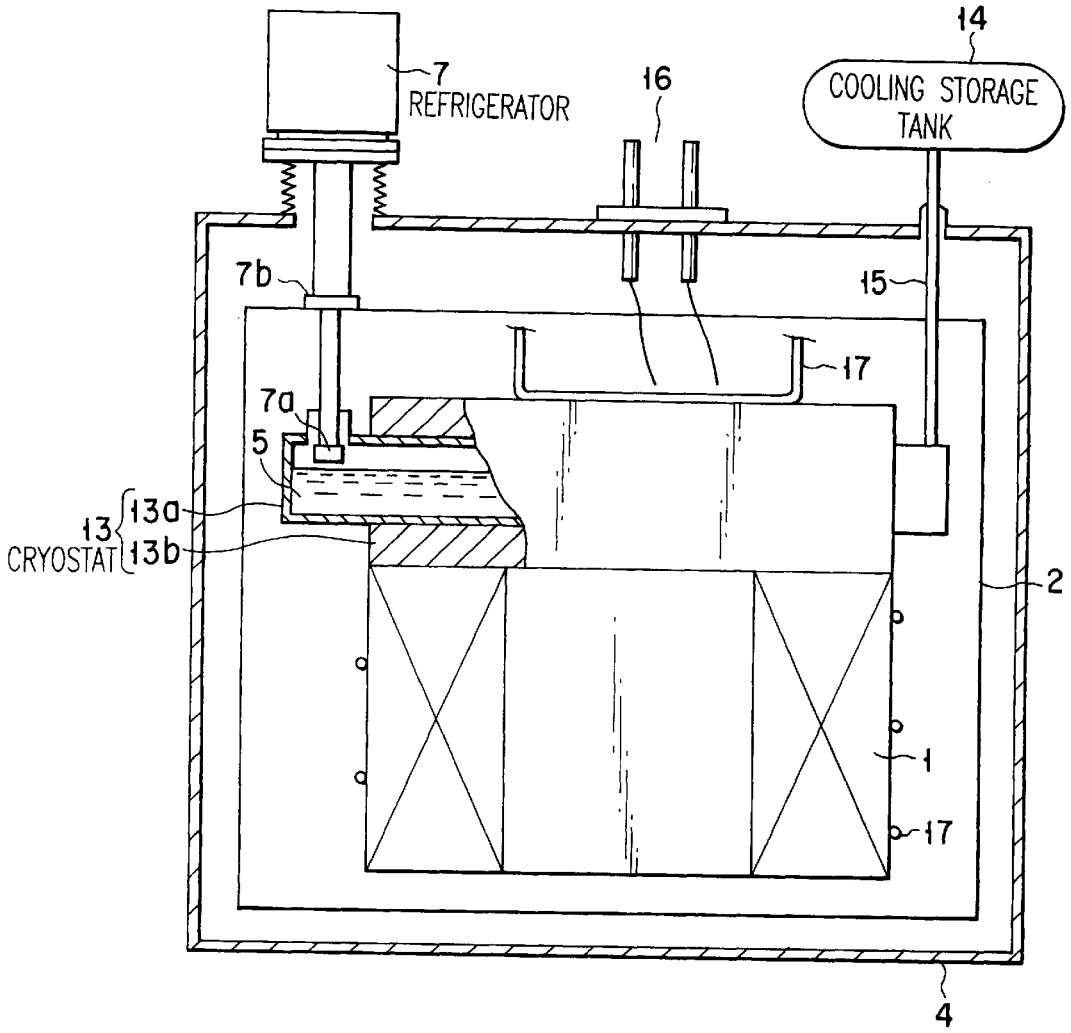
FIG. 3 is a sectional view of a superconducting magnet apparatus according to the first embodiment of the present invention.

Preferred embodiments of a superconducting magnet apparatus according to the present invention will be described with reference to the accompanying drawings. FIG. 3 is a sectional view of a superconducting magnet apparatus according to the first embodiment of the present invention.

Referring to FIG. 3, a superconducting coil 1 is surrounded by a radiation shield 2, and the radiation shield 2 is surrounded by a vacuum vessel 4. A cryostat 13 is disposed on the superconducting coil 1 and thermally connected to it. The cryostat 13 is constituted by a container 13*a* formed of a stainless steel pipe to store a coolant, and a block 13*b* made of a good heat conductor to hold the container 13*a*.

A low temperature-side stage 7*a* of a refrigerator 7 is inserted in the container 13*a* of the cryostat 13, and a high temperature-side stage 7*b* thereof is thermally connected to the radiation shield 2. A storage tank 14 for storing a coolant gas is provided to the vacuum vessel 4. The cryostat 13 and storage tank 14 communicate with each other through a communicating pipe 15. A coolant such as liquid helium 5 condensed by the low temperature-side stage 7*a* of the refrigerator 7 is stored in the cryostat 13.

Current leads 16 serve to supply a current from an external power supply (not shown) to the superconducting coil 1. The superconducting coil 1 and cryostat 13 are provided with pre-cooling pipes 17. The pre-cooling pipes 17 are connected to a supply system (not shown) placed outside the vacuum vessel 4 to supply a pre-heating coolant.

To operate the superconducting magnet apparatus according to the first embodiment having this arrangement, the interior of the vacuum vessel 4 is evacuated to a high vacuum degree by a vacuum pump (not shown), and the radiation shield 2 is cooled to a predetermined temperature by the refrigerator 7. If the superconducting coil 1 is a small one, it can be cooled to a predetermined temperature (e.g., 4.2 K) by only the refrigerator 7. If a 1-ton class superconducting coil 1 is used, pre-cooling takes as long as about one week.

If such a large superconducting coil 1 is used, it is pre-cooled by supplying the pre-cooling coolant to the pre-cooling pipes 17. For example, liquid nitrogen is supplied to the pre-cooling pipes 17 to cool the superconducting coil 1 to 80 K, so that the pre-cooling time is shortened to about ⅓. With copper, stainless steel, or the like that generally forms the superconducting coil 1, the higher the temperature, the larger its large specific heat. Therefore, a large effect can be obtained when the superconducting coil 1 is pre-cooled to 80 K. From the pre-cooling temperature of 80 K to 4.2 K, the superconducting coil 1 is cooled by the refrigerator 7. When liquid helium 5 is supplied into the cryostat 13 from the outside through a supply pipe, the superconducting coil 1 can be pre-cooled from 80 K down to 4 K within a short period of time (about 1 hour). When pre-cooling is complete, the coolant gas stored in the storage tank 14 by continuous operation of the refrigerator 7 is condensed to be liquefied by the low temperature-side stage 7*a* in the cryostat 13.

When the superconducting coil 1 is energized/deenergized, an AC loss is produced, and the heat load as the sum of the AC loss and the heat influx exceeds the cooling capacity of the refrigerator 7. In this case, the liquid helium stored in the cryostat 13 evaporates to compensate for the insufficient cooling capacity of the refrigerator 7 with its latent heat of its evaporation. The coolant gas evaporated at this time is temporarily stored in the storage tank 14. In ordinary operation, the superconducting coil 1 has no electric resistance. Even when a current is supplied to the superconducting coil 1, no Joule heat is generated but only heat influx exists. At this time, the cooling capacity of the refrigerator 7 exceeds the heat influx, and the evaporated coolant gas is therefore liquefied again in the cryostat 13.

According to this first embodiment, the cryostat 13 is provided. To cool the interior of the cryostat 13, a minimum amount of coolant necessary when the heat load exceeds the cooling capacity of the refrigerator 7 is stored in the cryostat 13, thereby cooling the superconducting coil 1 by conduction. The superconducting coil 1 can thus be cooled efficiently without immersing it in liquid helium. Thus, no coil container 18 is necessary for storing the superconducting coil 1.

As for non-steady state heat generation during energization/deenergization and the like, the heat can be removed by the latent heat of evaporation of the stored coolant. At this time, the evaporated coolant gas is temporarily stored in the storage tank 14 and liquefied again during ordinary operation. The coolant need not be supplied from the outside, and the apparatus is thus easy to handle.

In place of condensing liquid helium by the low temperature-side stage 7*a* of the refrigerator 7 and storing it in the cryostat 13, liquid helium in an amount corresponding to the evaporated amount may be filled in the cryostat 13 from the outside. The storage tank 14 may be formed integrally with the vacuum vessel 4. Although the liquid helium 5 is used as the coolant in this embodiment, in the case of a high-temperature superconducting magnet apparatus or the like, liquid nitrogen may be used as the coolant. Although the pre-cooling pipes 17 are provided to the superconducting coil 1 and cryostat 13, they may be provided to either the superconducting coil 1 or cryostat 13. Although the low temperature-side stage 7*a* is inserted in the cryostat 13, it need not be inserted if the low temperature-side stage 7*a* is thermally connected to the cryostat 13 directly or indirectly.

Figure 4:
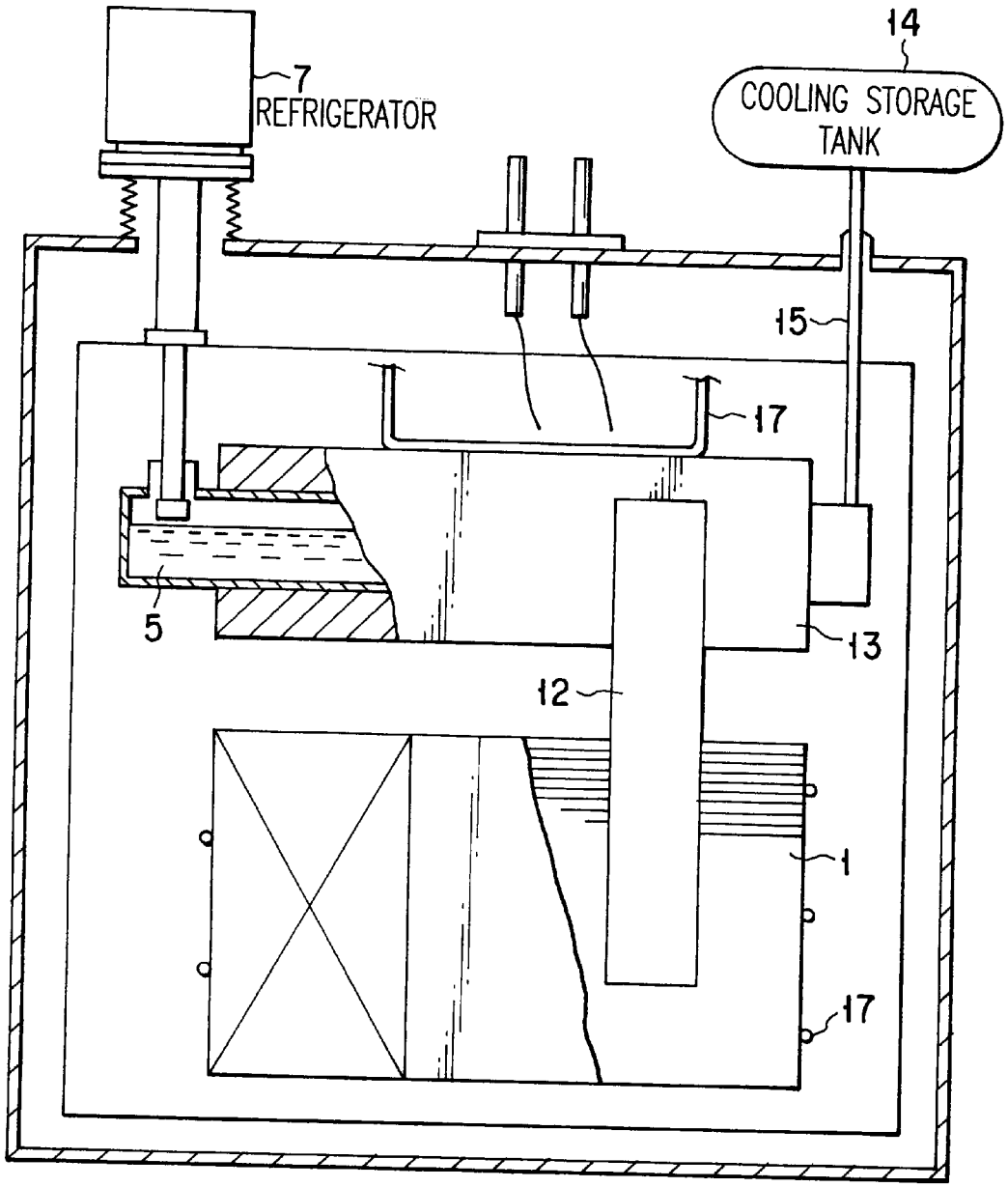
FIG. 4 is a sectional view of a superconducting magnet apparatus according to the second embodiment of the present invention.

The second embodiment of the present invention will be described. FIG. 4 is a sectional view of a superconducting magnet apparatus according to the second embodiment of the present invention. When the second embodiment is compared to the first embodiment shown in FIG. 3, a cryostat 13 and superconducting coil 1 are thermally connected to each other through a heat conducting member 12. Except for this, the second embodiment is identical to the first embodiment shown in FIG. 3. The identical elements are denoted by the same reference numerals, and a detailed description thereof will be omitted.

Referring to FIG. 4, the cryostat 13 is not directly connected to the superconducting coil 1, but the cryostat 13 and superconducting coil 1 are thermally connected to each other through the heat conducting member 12. As the heat conducting member 12, a flexible one formed by stacking a large number of thin copper or aluminum plates is used.

When this heat conducting member 12 is used, the superconducting coil 1 as a whole can be uniformly cooled. More specifically, in a structure wherein the cryostat 13 and superconducting coil 1 are in thermal contact with each other, the temperature is higher at a place farther from the contact portion of the cryostat 13 and superconducting coil 1. If a plurality of heat conducting members 12 each having an appropriate conduction area are used as in the second embodiment, the place where the heat conducting members 12 are attached to remove heat can be selected with a larger degree of freedom, and accordingly the temperature difference among the respective portions of the superconducting coil 1 can be minimized. Consequently, the operation temperature of the superconducting coil 1 can be suppressed uniformly low, and operation can be performed stably without quenching.

Since the heat conducting member 12 has flexibility and a very small natural frequency, it absorbs vibration of the refrigerator 7. As a result, heat generated by very small vibration of the superconducting coil 1 can be avoided. Generally, heat influx is a heat load of as very small as 1 W or less. Hence, the heat conducting member 12 can very effectively suppress the heat load inflicted upon by the disturbance or the like such as a very small vibration.

Figure 5:
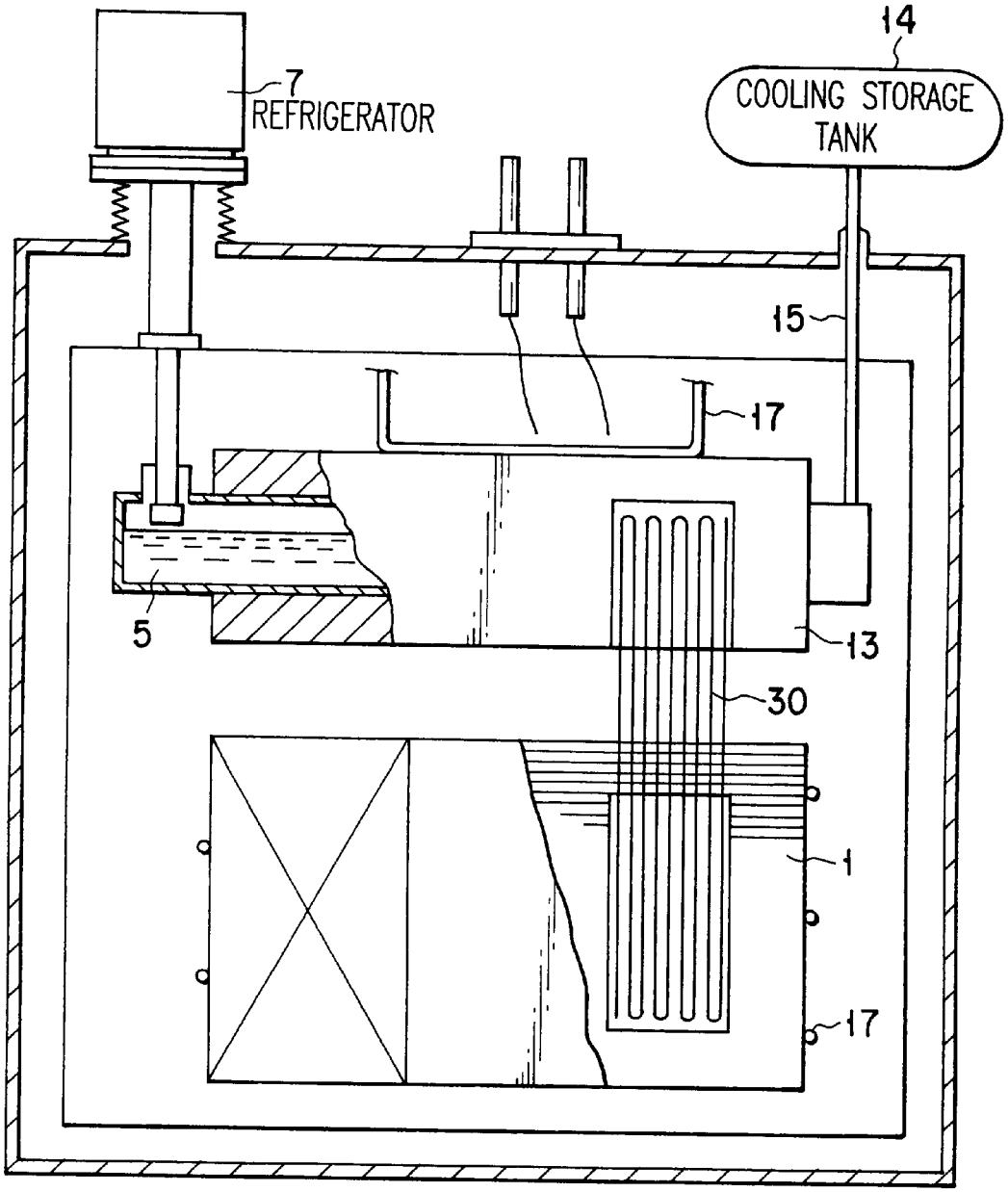
FIG. 5 is a sectional view of a superconducting magnet apparatus according to the second embodiment of the present invention, which employs a heat pipe as a heat conducting member.

FIG. 5 is a sectional view of a superconducting magnet apparatus according to the second embodiment of the present invention, which uses a heat pipe as a heat conducting member. As shown in FIG. 5, a narrow tube-type heat pipe 30 sealing helium or the like in it is used as the heat conducting member 12.

Since heat transfer of the heat pipe 30 is considerably larger than conduction cooling, the temperature difference of the narrow tube-type heat pipe 30 between the cryostat 13 side and superconducting coil 1 side can be decreased to close to zero. Temperature increase of the superconducting coil 1 can be decreased to as very small as about 0.2 K, and the superconducting coil 1 can be operated stably.

Although the coolant sealed in the narrow tube-type heat pipe 30 is helium in this case, the coolant is not limited to helium, and is arbitrarily selected according to the employed temperature. An example of coolant that can be used at a low temperature includes hydrogen, neon, nitrogen, fluorine, and the like.

Figure 6:
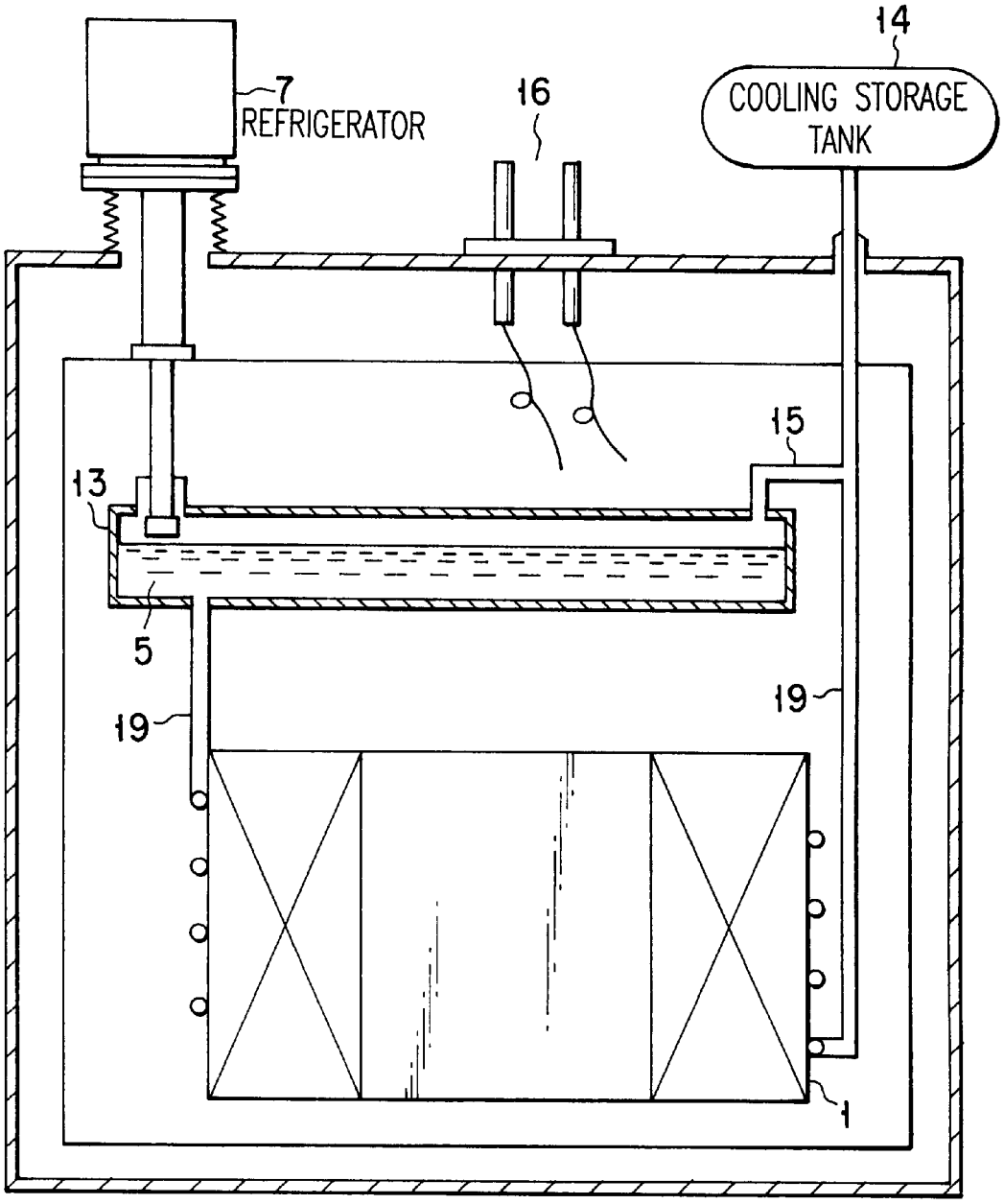
FIG. 6 is a sectional view of a superconducting magnet apparatus according to the third embodiment of the present invention.

The third embodiment of the present invention will be described. FIG. 6 is a sectional view of a superconducting magnet apparatus according to the third embodiment of the present invention. When the third embodiment is compared to the second embodiment shown in FIGS. 4 and 5, cooling pipes 19 are provided in place of the heat conducting member 12 (heat pipe 30) in thermal contact with a superconducting coil 1, in order to circulate liquid helium stored in a cryostat 13.

More specifically, in the second embodiment, the cryostat 13 and superconducting coil 1 are thermally connected to each other through the heat conducting member 12. In contrast to this, in the third embodiment, in place of the heat conducting member 12 (heat pipe 30), the cooling pipes 19 for circulating the liquid helium stored in the cryostat 13 are provided in thermal contact with the superconducting coil 1, thereby cooling the superconducting coil 1.

Heat influx into the superconducting coil 1 or heat generated by AC loss is transferred to liquid helium 5 through the pipe walls of the cooling pipes 19. During heat transfer, the liquid helium 5 evaporates to absorb the generated heat with the latent heat of evaporation. The evaporated helium 5 is returned to the cryostat 13 and liquefied again to flow through the cooling pipes 19, so as to cool the superconducting coil 1.

In the third embodiment, since the superconducting coil 1 is cooled by the latent heat of evaporation of the liquid helium 5 flowing through the cooling pipes 19, no temperature difference occurs in the cooling pipes 19, and the temperature of the cooling pipes 19 is always maintained at 4.2 K, which is the temperature of liquid helium. Hence, when compared to conduction cooling using the heat conducting member 12, any temperature increase of the superconducting coil 1 can be decreased very small, and the superconducting coil 1 can be operated stably.

To connect the cooling pipes 19 to the superconducting coil 1, the cooling pipes 19 are formed into winding pipes having flexed portions on their ends in the axial direction of the superconducting coil 1. As a result, when the superconducting coil 1 deforms by the electromagnetic force, the flexed portions of the cooling pipes 19 can move free from the superconducting coil 1 while only their linear portions stay in thermal contact with the superconducting coil 1 by adhesion or the like, so that the cooling pipes 19 can follow deformation of the superconducting coil 1.

Figure 7:
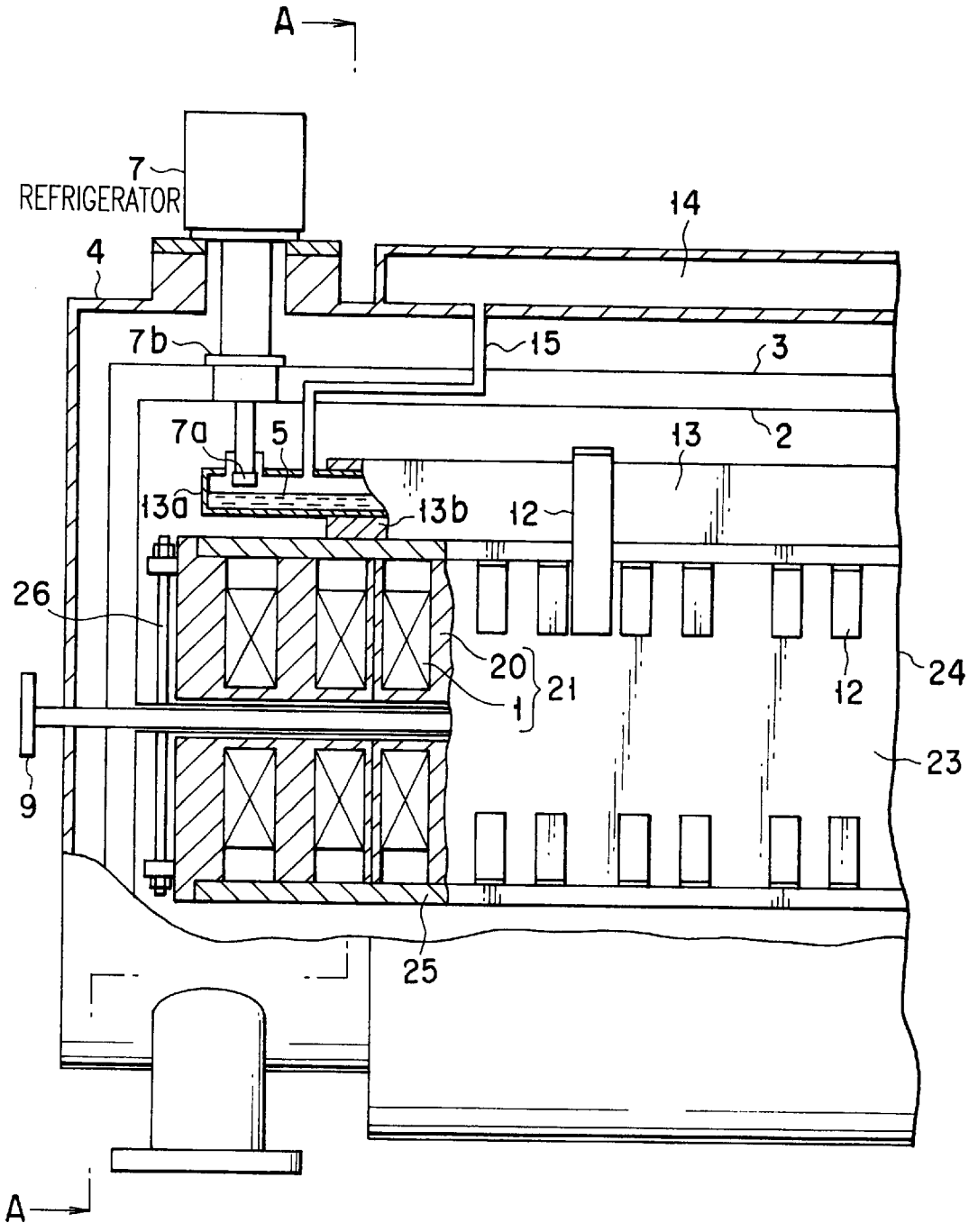
FIG. 7 is a sectional view of a superconducting magnet apparatus according to the fourth embodiment of the present invention.
Figure 8:
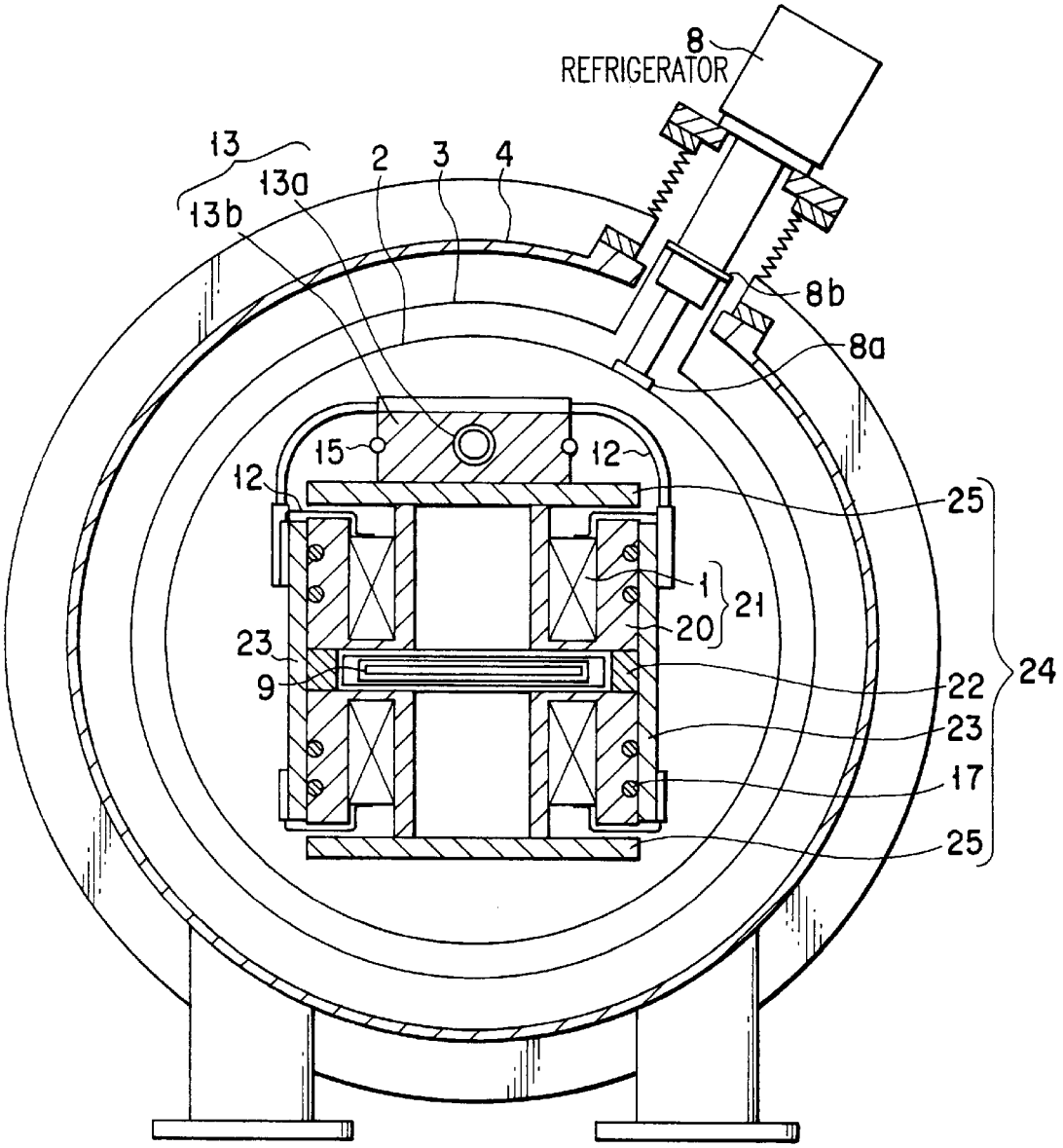
FIG. 8 is a sectional view taken along the line A—A of FIG. 7.

The fourth embodiment of the present invention shown in FIG. 7 will be described. FIG. 7 is a sectional view of a superconducting magnet apparatus according to the fourth embodiment of the present invention, and FIG. 8 is a sectional view taken along the line A—A of FIG. 7. The superconducting magnet apparatus according to the fourth embodiment is a wiggler superconducting magnet apparatus for a synchrotron orbital radiation device.

Referring to FIG. 7, a plurality of superconducting coils 1 are provided. More specifically, a plurality of pairs of superconducting coils 1, each pair of which vertically oppose each other through a beam chamber 9, are aligned in the longitudinal direction of the beam chamber 9. The superconducting coils 1 are stored in coil frames 20 to constitute superconducting coil units 21. The respective superconducting coil units 21 are integrally connected to each other in the longitudinal direction with a connecting member 25. Furthermore, common cooling plates 23 are attached to the two side surfaces of the integrated structure of the superconducting coil units 21.

As shown in FIG. 8, the upper and lower superconducting coil units 21 are connected to each other through spacing pieces 22, and the coil frames 20 are provided with pre-cooling pipes 17, thus forming a superconducting coil assembly 24. More specifically, the superconducting coil assembly 24 is comprised of the superconducting coil units 21 consisting of the superconducting coils 1 and coil frames 20, the pre-cooling pipes 17 provided to the coil frames 20, the spacing pieces 22, the common cooling plate 23, and the connecting member 25. A cryostat 13 is disposed on the superconducting coil assembly 24. The cryostat 13 is formed by connecting a block 13*b* made of a good heat conductor to a container 13*a* formed of a stainless steel pipe to reserve liquid helium 5. The cryostat 13 has a large strength and can obtain good heat conduction.

A radiation shield 2 surrounds the superconducting coil assembly 24, and a high temperature-side shield 3 and vacuum vessel 4 surround the radiation shield 2. The cryostat 13 and common cooling plate 23 are thermally connected to each other with heat conducting members 12. The superconducting coils 1 stored in the coil frames 20 and the common cooling plate 23 are also thermally connected to each other with the heat conducting members 12.

As shown in FIG. 7, a liquefying/refrigerator 7 for liquefying helium is mounted on the cryostat 13. The cryostat 13 is constantly held at a temperature of 4.2 K or less by the liquefied liquid helium 5. A low temperature-side stage 7*a* of the refrigerator 7 is thermally connected to the superconducting coils 1 through the heat conducting members 12, and a high temperature-side stage 7*b* thereof is thermally connected to the radiation shield 2. The low and high temperature-side stages 7*a* and 7*b* are cooled to temperatures of about 4.2 K and 80 K, respectively.

The superconducting coil assembly 24 is hung from the high temperature-side shield 3 with a heat insulating support member 26 and assembled at a predetermined position. Part of the outer circumference of the vacuum vessel 4 forms a double-wall container, and the annular space between the two walls of the double-wall container forms a helium storage tank 14. The storage tank 14 and cryostat 13 communicate with each other through a communicating pipe 15.

As shown in FIG. 8, a low and high temperature-side stages 8*a* and 8*b* of the shield cooling refrigerator 8 cool the radiation shield 2 and high temperature-side shield 3, respectively, and are held at temperatures of about 80 K and 20 K, respectively.

This superconducting magnet apparatus operates basically in the same manner as in the first embodiment described above. In addition to the functions as described above, in the fourth embodiment, the plurality of superconducting coils 1 are thermally integrated with each other with the common cooling plates 23. Since the heat resistances become almost equal among the respective superconducting coils 1 and cryostat 13, the respective superconducting coil 1 can be cooled uniformly.

Since the plurality of superconducting coils 1 are integrally cooled by one refrigerator 7, the heat conducting members 12 need not be connected to the respective superconducting coils 1, resulting in a simple structure. In particular, even if this superconducting magnet apparatus is an elongated one comprising a plurality of superconducting coils 1, if the length of the cryostat 13 is set equal to that of the superconducting coil assembly 24, the respective superconducting coils 1 can be uniformly cooled.

At the initial stage of cooling, for example, liquid nitrogen is supplied to the pre-cooling pipes 17 to pre-cool the superconducting coils 1 through the common cooling plates 23. With copper, stainless steel, or the like that generally constitutes the superconducting coils 1, the higher the temperature, the larger its specific heat. If the superconducting coils 1 are pre-cooled by inexpensive liquid nitrogen having a large heat removing capacity from 300 K to 80 K, the pre-cooling time can be shortened greatly.

Since the storage tank 14 is formed in part of the vacuum vessel 4, a separate, external gas storage tank 14 is not needed. No space is necessary to install pipes through which such a gas storage tank 14 and the superconducting magnet apparatus communicate with each other, so the apparatus can be placed in a compact shape. Since the cylindrical portion of the vacuum vessel 4 forms a double-wall container to build the storage tank 14, the plate thickness of the vacuum vessel 4 can be decreased. Since an increase in outer diameter of the vacuum vessel 4 can be minimized to realize a storage tank 14 having a large capacity, the weight and manufacturing cost can be decreased.

Although the pre-cooling pipes 17 are provided to the coil frames 20 in the fourth embodiment, they may be connected to the block 13*b* constituting the cryostat 13, or to the common cooling plates 23. In the same manner as in the third embodiment, in place of the heat conducting members 12, cooling pipes 19 for circulating liquid helium stored in the cryostat 13 may be formed in thermal contact with the common cooling plates 23.

Figure 9:
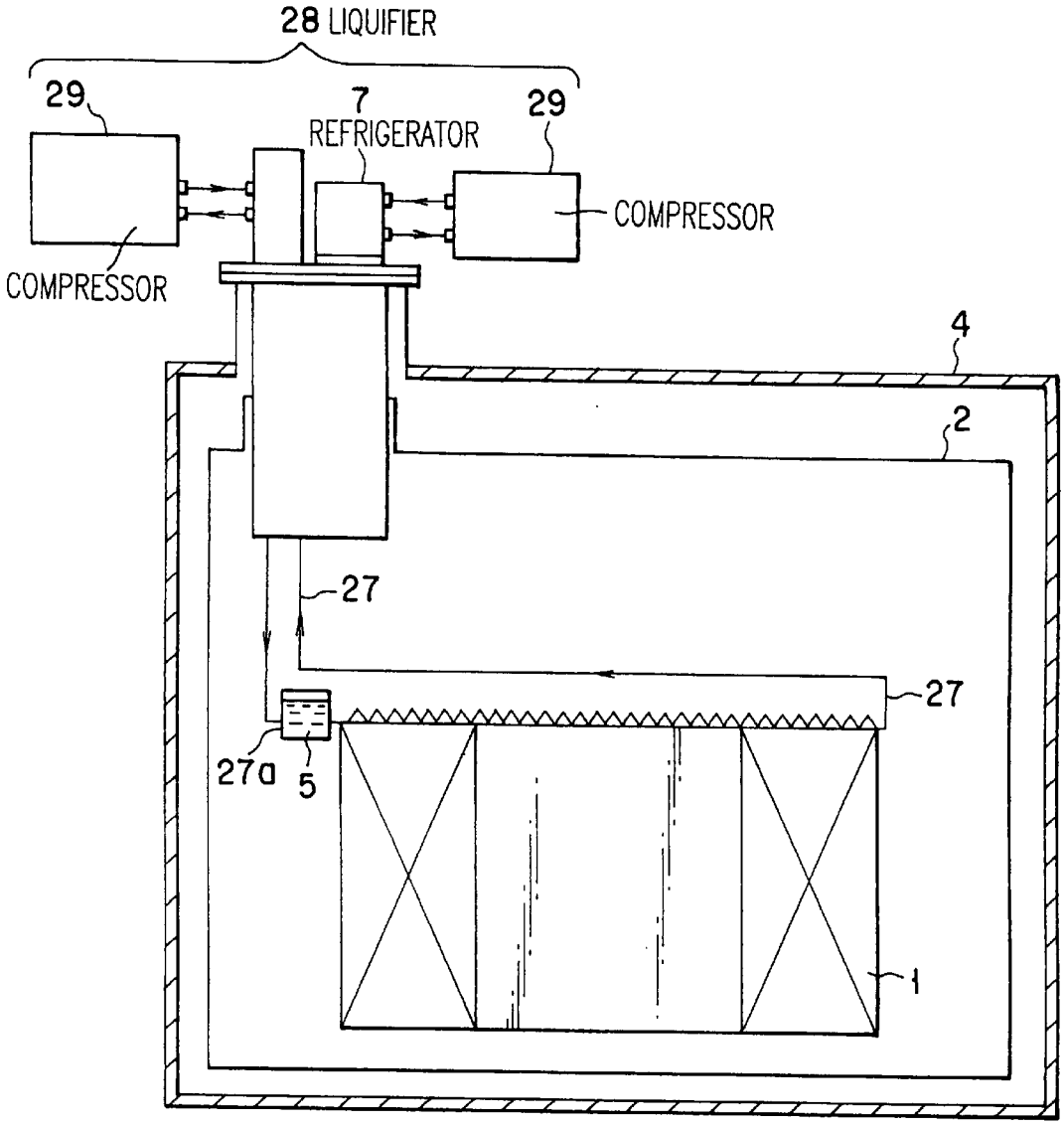
FIG. 9 is a sectional view of a superconducting magnet apparatus according to the fifth embodiment of the present invention.

The fifth embodiment of the present invention will be described. FIG. 9 is a sectional view of a superconducting magnet apparatus according to the fifth embodiment of the present invention. In the fifth embodiment, a coolant cooled by a refrigerator 7 is circulated through a cryogenic pipe 27 provided in thermal contact with a superconducting coil 1 directly or indirectly, thereby cooling the superconducting coil 1.

Referring to FIG. 9, in the superconducting magnet apparatus, the superconducting coil 1 is surrounded by a radiation shield 2, which is, in turn surrounded by a vacuum vessel 4. A refrigerating/liquefying machine 28 is constituted by the refrigerator 7 and a compressor 29. The cryogenic pipe 27 connected to the refrigerating/liquefying machine 28 is mounted in thermal contact with the superconducting coil 1.

To operate this superconducting magnet apparatus, the interior of the vacuum vessel 4 is evacuated to a high vacuum degree by a vacuum pump (not shown), and the radiation shield 2 and superconducting coil 1 are cooled to a predetermined temperature by the refrigerating/liquefying machine 28. When pre-cooling is completed, liquid helium 5 is liquefied and reserved in the cryogenic pipe 27 by continuous operation of the refrigerating/liquefying machine 28.

When the superconducting coil 1 is energized/deenergized, heat is generated by an AC loss. The heat load as the sum of the AC loss and the heat influx exceeds the cooling capacity of the refrigerating/liquefying machine 28. In this case, the liquid helium 5 stored in the cryogenic pipe 27 evaporates to compensate for the insufficient cooling capacity of the refrigerating/liquefying machine 28 with its latent heat of its evaporation. The coolant gas evaporated at this time is temporarily stored in the compressor 29 constituting the refrigerating/liquefying machine 28.

In ordinary operation, the superconducting coil 1 has no electric resistance. Even when a current is supplied to the superconducting coil 1, no Joule heat is generated but only heat influx exists. At this time, the cooling capacity of the refrigerating/liquefying machine 28 exceeds the heat influx, and the evaporated coolant gas is therefore liquefied again to be reserved in the cryogenic pipe 27.

According to this fifth embodiment, a minimum amount of coolant necessary for cooling is stored in the cryogenic pipe 27 to cool the superconducting coil 1. The superconducting coil 1 can thus be cooled efficiently without immersing it in liquid helium. No coil container 18 is necessary for storing the superconducting coil 1. As for non-steady state heat generation during energization/deenergization and the like, the heat can be removed by the latent heat of evaporation of the stored coolant. At this time, the evaporated coolant gas is liquefied again by the refrigerating/liquefying machine 28. The coolant need not be supplied from the outside, and the apparatus is thus easy to handle.

Since the superconducting coil 1 is cooled by heat transfer and heat of evaporation of the liquid helium flowing through the cryogenic pipe 27, as compared to conduction cooling using the heat conducting member 12, a temperature increase in the superconducting coil 1 can be minimized. As a result, the superconducting coil 1 can be operated stably. Only the cryogenic pipe 27 need be connected to the superconducting coil 1 and no other heat conducting member 12 is necessary, simplifying the structure.

As shown in FIG. 9, a coolant reservoir 27*a* having a diameter greatly larger (having a larger volume per unit length) than that of the cryogenic pipe 27 is formed in part of the cryogenic pipe 27, so that the amount of coolant stored in the cryogenic pipe 27 can be increased. Even when non-steady state heat generation occurs during energization/deenergization or the like, the superconducting coil 1 can be operated stably. Furthermore, the cryogenic pipe 27 need not be directly attached to the superconducting coil 1, but may be attached to a cooling member that is in thermal contact with the superconducting coil 1, to indirectly cool the superconducting coil 1.

As has been described above, according to the present invention, a superconducting coil can be cooled efficiently without immersing it in a coolant. Even if energization/deenergization is performed often or the energization/deenergization time is short to generate a large amount of heat by an AC loss, the superconducting coil can be operated stably by minimizing an increase in its temperature. As a result, an easy-to-handle superconducting magnet apparatus having a high cooling capacity and high reliability can be provided.

More specifically, a minimum amount of coolant required for cooling is stored in a cryostat, and the superconducting coil is conduction-cooled through a heat conducting member. The superconducting coil can be cooled efficiently without immersing it in liquid helium. No helium container is required to store the superconducting coil. When non-steady state heat generation is caused by energization/deenergization or the like, the heat can be removed by the latent heat of evaporation of the stored coolant.

Since the superconducting coil is cooled by heat transfer of liquid helium flowing through the cooling pipe, as compared to conduction cooling employing a heat conducting member, a temperature increase of the superconducting coil can be minimized. As a result, the superconducting coil can be operated stably.

Since a plurality of superconducting coils are thermally integrated with each other with the common cooling plates and the heat resistances of the heat conducting member become nearly equal among the respective heat conducting coils and the cryostat, the respective superconducting coils can be cooled uniformly. Also, the structure is simplified.

Since the common cooling plates are cooled by heat transfer of liquid helium flowing through the cooling pipe, as compared to conduction cooling employing a heat conducting member, a temperature increase of the superconducting coils can be minimized. As a result, the superconducting coils can be operated stably.

According to the present invention, the coolant need not be supplied externally. If a necessary amount of coolant gas is prepared, it can be liquefied by the refrigerator. During operation, the evaporated gas is liquefied. Therefore, the apparatus is easy to handle.

According to the present invention, a cryostat having excellent heat conduction and high strength can be obtained. In particular, if the coolant container is formed into a cylindrical pipe, the anti-pressure performance can be improved.

If a narrow tube type heat pipe that seals a coolant, e.g., helium, having a large heat transfer rate is used, as compared to conduction cooling employing a heat conducting member formed of a copper plate or aluminum plate, a temperature increase of the superconducting coil can be minimized. As a result, the superconducting coil can be operated stably.

At the initial stage of cooling, for example, liquid nitrogen can be supplied to the pre-cooling pipe to pre-cool the superconducting coil. With copper, stainless steel, or the like that generally forms a superconducting coil, the higher the temperature, the larger its specific heat. If the superconducting coil is pre-cooled by liquid nitrogen from 300 K to 80 K, the pre-cooling time can be shortened greatly.

At the initial stage of cooling, for example, liquid nitrogen can be supplied to the pre-cooling pipe to pre-cool the superconducting coil through the common cooling plates. As for copper, stainless steel, or the like that generally forms a superconducting coil, the higher the temperature, the larger its specific heat. If the superconducting coil is pre-cooled by inexpensive liquid nitrogen having a large heat removing capacity from 300 K to 80 K, the pre-cooling time can be shortened greatly.

According to the present invention, an external gas storage tank is not needed. No space is necessary to install pipes through which such a gas storage tank and the superconducting magnet communicate with each other, so that the apparatus can be placed compactly.

According to the present invention, the weight and manufacturing cost can be decreased. If the cylindrical portion of the vacuum vessel is formed as a double-wall container, the plate thickness can be decreased, and an increase in outer diameter of the vacuum vessel can be minimized, thereby forming a large-capacity storage tank.

Since the superconducting coil is cooled by heat transfer of liquid helium flowing through the coolant pipe, as compared to conduction cooling employing a heat conducting member, a temperature increase of the superconducting coil can be minimized. As a result, the superconducting coil can be operated stably. Only a cryogenic pipe need be provided to the superconducting coil, and no other heat conducting member is required, simplifying the structure.

When a liquid reservoir is provided to the coolant pipe, the amount of coolant stored in the coolant pipe can be increased. Even if non-steady state heat generation occurs during energization/deenergization or the like, the superconducting coil can be operated stably.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A superconducting magnet apparatus comprising:

a superconducting coil for generating a magnetic field;

a radiation shield surrounding said superconducting coil;

a refrigerator for cooling said superconducting coil; and a container provided inside said radiation shield and isolated from said superconducting coil to store a coolant cooled by said refrigerator; and a heat conductive member for holding said container, said heat conductive member being thermally connected to said superconducting coil and said container, wherein said refrigerator liquefies the coolant in said container.

2. An apparatus according to claim 1, further comprising a storage tank for storing a gas of the coolant, and a communicating pipe for allowing said storage tank and said container to comminute with each other.

3. An apparatus according to claim 2, wherein said storage tank is integrated with a vacuum vessel that surrounds said radiation shield.

4. An apparatus according to claim 1, wherein said container and said superconducting coil are thermally connected to each other through a heat transfer member.

5. An apparatus according to claim 4, wherein said heat transfer member is a heat pipe.

6. An apparatus according to claim 1, further comprising a pre-cooling pipe provided to at least one of said superconducting coil and said container to pre-cool said at least one of said superconducting coil and said container.

7. A superconducting magnet apparatus comprising:

a superconducting coil for generating a magnetic field;

a radiation shield surrounding said superconducting coil;

a refrigerator for cooling said superconducting coil;

a container provided inside said radiation shield and isolated from said superconducting coil to store a coolant cooled by said refrigerator;

a heat conductive member for holding said container, said heat conductive member being thermally connected to said container; and a cooling pipe provided in thermal contact with said superconducting coil and said heat conductive member to circulate the coolant stored in said container, wherein said refrigerator liquefies the coolant in said container.

8. An apparatus according to claim 7, further comprising a storage tank for storing a gas of the coolant, and a communicating pipe for allowing said storage tank and said container to comminute with each other.

9. An apparatus according to claim 8, wherein said storage tank is integrated with a vacuum vessel that surrounds said radiation shield.

10. An apparatus according to claim 7, further comprising a pre-cooling pipe provided to at least one of said superconducting coil and said container to pre-cool said at least one of said superconducting coil and said container.

11. A superconducting magnet apparatus comprising:

a plurality of superconducting coils for generating a magnetic field;

a radiation shield integrally surrounding said plurality of superconducting coils;

a refrigerator for cooling said superconducting coils;

a common cooling plate for thermally connecting said plurality of superconducting coils to each other;

a container provided inside said radiation shield and isolated from said plurality of superconducting coils to store a coolant cooled by said refrigerator; and a heat conductive member for holding said container, said heat conductive member being thermally connected to said plurality of superconducting coils and said container, wherein said refrigerator liquefies the coolant in said container.

12. An apparatus according to claim 11, further comprising a storage tank for storing a gas of the coolant, and a communicating pipe for allowing said storage tank and said container to communicate with each other.

13. An apparatus according to claim 12, wherein said storage tank is integrated with a vacuum vessel that surrounds said radiation shield.

14. An apparatus according to claim 11, wherein said container and said superconducting coils are thermally connected to each other through a heat transfer member.

15. An apparatus according to claim 14, wherein said heat transfer member is a heat pipe.

16. An apparatus according to claim 11, further comprising a pre-cooling pipe for cooling at least one of said common cooling plate and said container.

17. A superconducting magnet apparatus comprising:

a plurality of superconducting coils for generating a magnetic field;

a radiation shield integrally surrounding said plurality of superconducting coils;

a refrigerator for cooling said superconducting coils;

a common cooling plate for thermally connecting said plurality of superconducting coils to each other;

a container provided inside said radiation shield and isolated from said plurality of superconducting coils to store a coolant cooled by said refrigerator;

a heat conductive member for holding said container, said heat conductive member being thermally connected to said plurality of superconducting coils and said container; and a cooling pipe provided in thermal contact with said common cooling plate and said heat conductive member, to circulate the coolant stored in said containers wherein said refrigerator liquefies the coolant in said container.

18. An apparatus according to claim 17, further comprising a storage tank for storing a gas of the coolant, and a communicating pipe for allowing said storage tank and said container to communicate with each other.

19. An apparatus according to claim 18, wherein said storage tank is integrated with a vacuum vessel that surrounds said radiation shield.

20. An apparatus according to claim 17, further comprising a pre-cooling pipe provided to at least one of said superconducting coils and said container to pre-cool said at least one of said superconducting coils and said container.

21. A superconducting magnet apparatus comprising:

a superconducting coil for generating a magnetic field;

a radiation shield surrounding said super conducting coil;

a refrigerator for cooling said superconducting coil; and a cryogenic pipe provided in thermal contact with said superconducting coil and isolated from said superconducting coil, to circulate a liquefied coolant supplied from said refrigerator, wherein said refrigerator liquefies the coolant in said cryogenic pipe.

22. An apparatus according to claim 21, further comprising a coolant reservoir having a diameter larger than that of said cryogenic pipe and which is joined with said cryogenic pipe.

* * * * *